US006959461B1

(12) United States Patent
Sanchez

(10) Patent No.: US 6,959,461 B1
(45) Date of Patent: Nov. 1, 2005

(54) DETACHABLE SINK ACCESSORY

(76) Inventor: Herminio Sanchez, 146 Chester Ave., Bloomfield, NJ (US) 07003

( * ) Notice: Subject to any disclaimer, the term of this patent is extended or adjusted under 35 U.S.C. 154(b) by 0 days.

(21) Appl. No.: 11/059,029

(22) Filed: Feb. 17, 2005

(51) Int. Cl.[7] ..... A47K 1/06; E03C 1/181
(52) U.S. Cl. ..... 4/654; 4/658
(58) Field of Search ..... 4/654, 655, 658; 134/175, 183, 200

(56) References Cited

U.S. PATENT DOCUMENTS

| | | | | |
|---|---|---|---|---|
| 914,120 A | | 3/1909 | Demarest | |
| 2,039,490 A | | 5/1936 | Mikelson | |
| 2,508,808 A | | 5/1950 | Warman | |
| 4,768,534 A | | 9/1988 | Anderson | |
| 4,886,081 A | * | 12/1989 | Blaul | 134/200 |
| 5,012,537 A | | 5/1991 | Underwood | |
| 5,991,942 A | | 11/1999 | Neal | |
| D449,875 S | | 10/2001 | Fludd-Robinson et al. | |

* cited by examiner

*Primary Examiner*—Tuan Nguyen

(57) ABSTRACT

A detachable sink accessory includes a unitary and continuous body having a substantially dome shape covering a surface area of a sink. The body is situated forwardly of the faucet and extends upwardly from the sink about a top perimeter thereof. A plurality of coextensive openings are equidistantly spaced along a front surface of the body and extend upwardly from the bottom surface of the body and terminate subjacent to an apex of the body. The present invention further includes a plurality of monolithically formed flange portions protruding away from the opposed corners of the body such that the body can be removably positioned on a support surface surrounding the perimeter of the sink. The outer surface of the body is transparent such that a user can maintain a continuous line of sight into the sink while standing exterior of the body.

15 Claims, 4 Drawing Sheets

DETACHABLE SINK ACCESSORY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to kitchen accessories and, more particularly, to a detachable sink accessory for preventing undesirable foodstuff and fluids from contaminating surrounding areas.

2. Prior Art

A common problem with food processing such as potato peeling, fish scaling, corn husking, and the like, is that the removed food particles and waste are frequently strewn about the processing area due to a user's propensity to perform such operations in a quick and efficient manner, utilizing as little time as possible.

Unfortunately, such action creates safety problems and issues because moist and slippery food items may fall on the floor, potentially causing a slip or fall. Additionally, these food items may go unnoticed, except by the ever present ants and other insects attracted thereto. This poses a sanitary problem which could have been avoided if a cover or shield was used during the food processing.

Another problem frequently encountered with such activities is that the water from the faucet used to cleanse such food, is sprayed about the counter, causing moisture problems with adjacent walls and moldings, while at the same time contaminating other dishes and cookware that may have just been cleaned or are just about to be used.

Accordingly, a need remains for a detachable sink accessory that can be put in place during food processing activities, and then removed when not needed. The present invention satisfies such a need by providing a detachable sink accessory to prevent the splatters and stains on floors and countertops produced while cleaning fish, dicing onions, chopping meats, and performing other tasks in a kitchen sink. Such an accessory could also be used in commercial kitchens where the volume of food processing is much greater, and the resultant risk of slip or fall is greater. With this invention, a kitchen would be easier to clean, saving a user time and effort.

BRIEF SUMMARY OF THE INVENTION

In view of the foregoing background, it is therefore an object of the present invention to provide an apparatus for preventing undesirable fluids and food particles from escaping a sink cavity and contaminating surrounding areas. These and other objects, features, and advantages of the invention are provided by a detachable sink accessory including a unitary and continuous body preferably formed from non-corrosive material having opposed corners and an outer surface having a substantially dome shape covering a surface area of the sink.

The body is situated forwardly of the faucet and extends upwardly from the sink and about a top perimeter thereof. Such a body further has a bottom surface maintaining continuous surface contact with a perimeter of the sink during operating conditions. A plurality of coextensive openings are equidistantly spaced along a front surface of the body and extend upwardly from the bottom surface of the body and terminate subjacent to an apex of the body. Such openings preferably have a substantially arcuate shape and are sized and shaped for receiving a user's hands and arms therethrough such that a user can maneuver foodstuff positioned within a cavity of the sink.

The present invention further includes a plurality of monolithically formed flange portions protruding away from the opposed corners of the body such that the body can be removably positioned on a support surface surrounding the perimeter of the sink. The outer surface of the body is preferably transparent such that a user can maintain a continuous line of sight into the sink while standing exterior of the body. The body further may have a monolithically formed finger portion medially situated between the opening and engageable with the sink perimeter for assisting to maintain the body at a substantially stable position during operating conditions.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
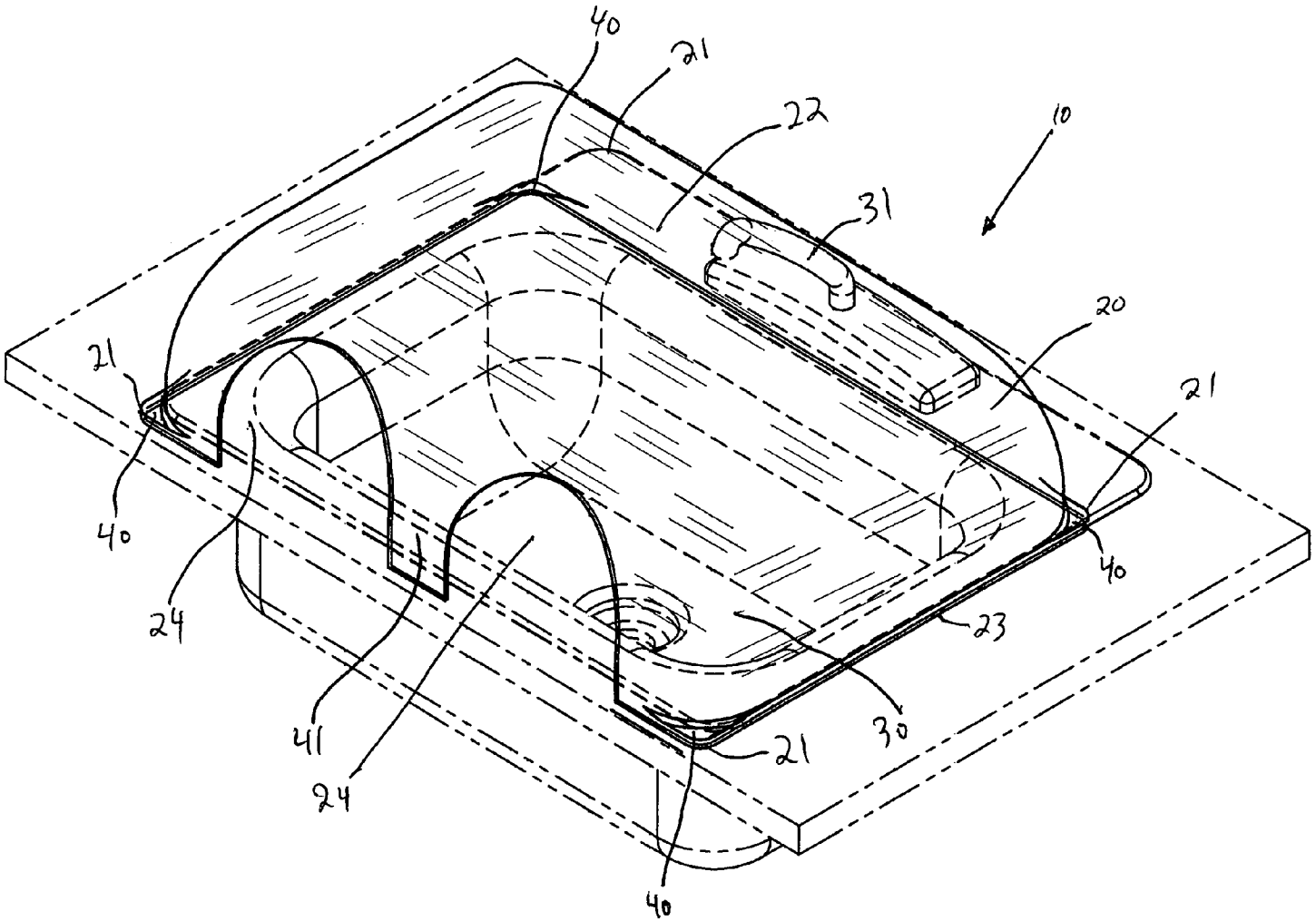
FIG. 1 is a perspective view showing a detachable sink accessory, in a preferred environment, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–4 by the reference numeral 10 and is intended to provide a detachable sink assembly for preventing undesirable fluids and food particles from escaping a sink cavity and contaminating surrounding areas. It should be understood that the apparatus 10 may be used to prevent the escape of contaminants from many different areas and should not be limited to use only with sinks.

Figure 2:
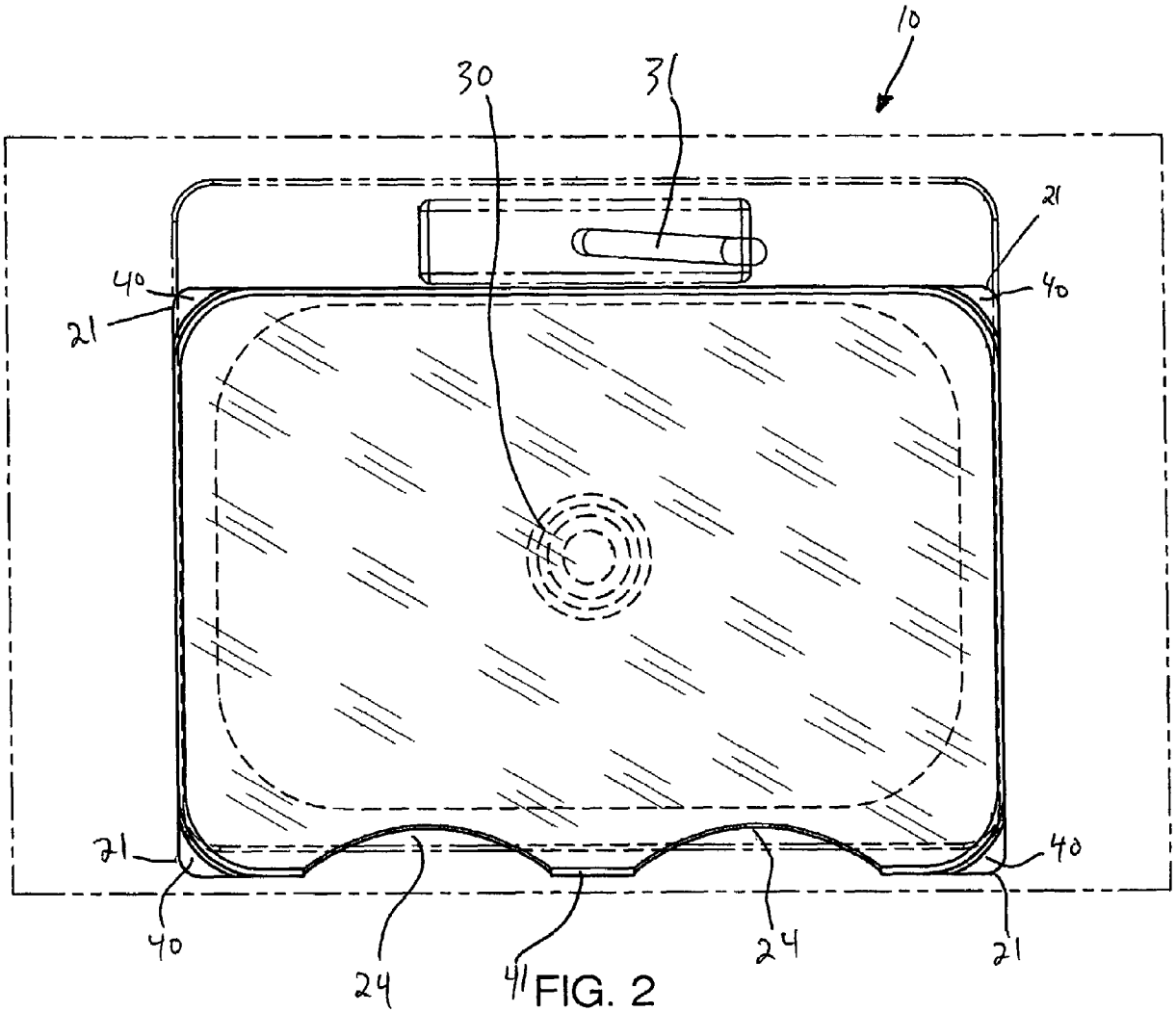
FIG. 2 is a top plan view of the accessory shown in FIG. 1.
Figure 3:
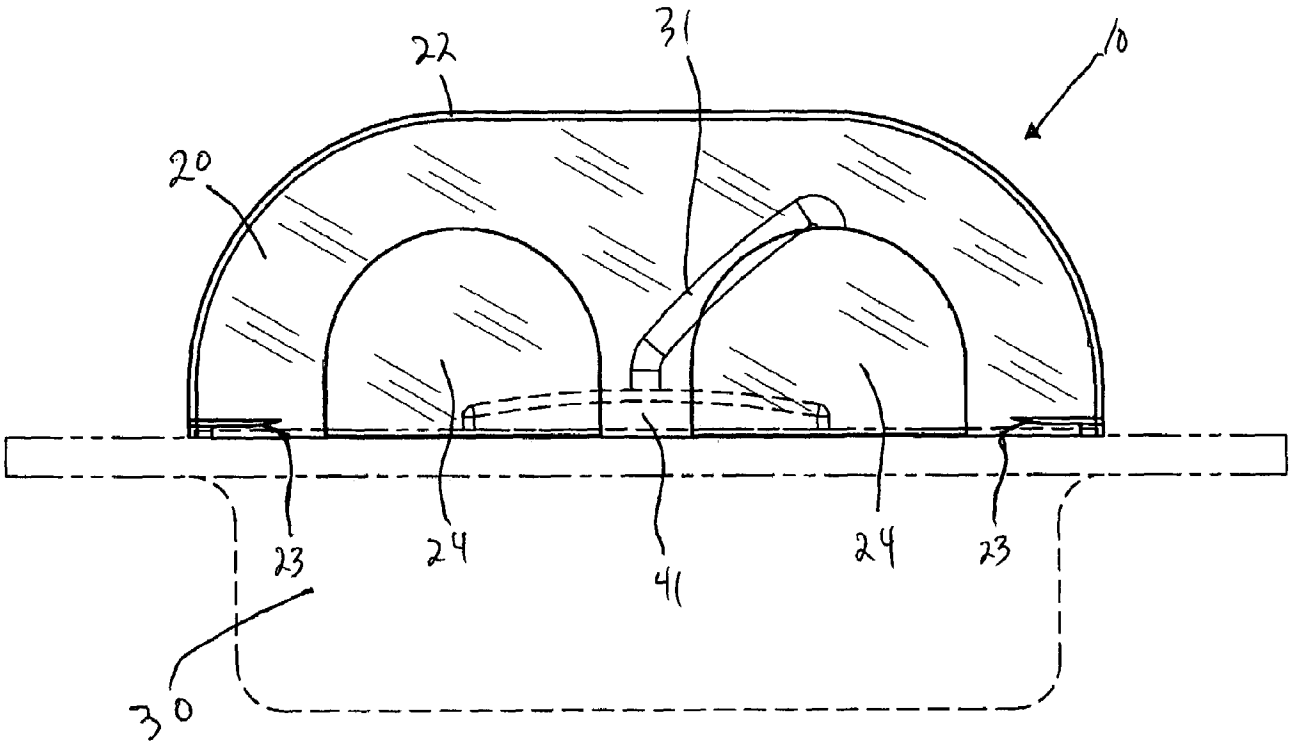
FIG. 3 is a front elevational view of the accessory shown in FIG. 1, showing the plurality of openings.
Figure 4:
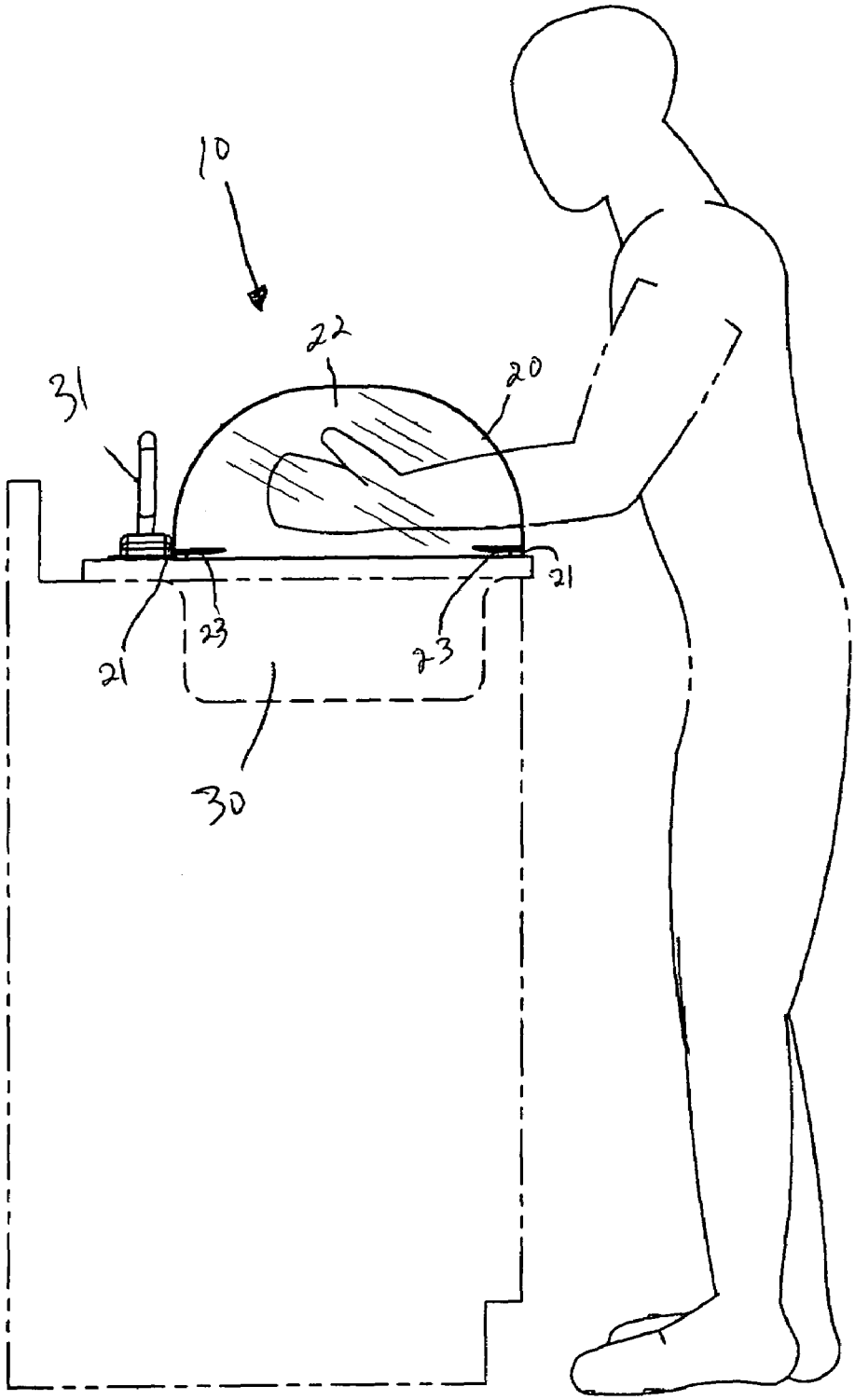
FIG. 4 is a side elevational view of the accessory shown in FIG. 1, in a preferred environment during operating conditions.

Referring initially to FIGS. 1, 2, and 3, the apparatus 10 includes a unitary and continuous body 20 preferably formed from non-corrosive material such as durable, crack resistant plastic and having opposed corners 21. Of course, such a body 20 could be either disposable or re-useable, as is obvious to one having ordinary skill in the art. An outer surface 22 having a substantially dome shape, as best shown in FIGS. 3 and 4, covers a surface area of the sink 30. The body 20 is situated forwardly of the faucet 31 and extends upwardly from the sink 30 and about a top perimeter thereof. Such a body 20 further has a bottom surface 23 maintaining continuous surface contact with a perimeter of the sink 30 during operating conditions to prevent fluid and debris from escaping therefrom and potentially staining the countertop.

A plurality of coextensive openings 24 are equidistantly spaced along a front surface 25 of the body 20 and extend upwardly from the bottom surface 23 of the body 20, terminating subjacent to an apex of the body 20. Such openings 24 preferably have a substantially arcuate shape and are sized and shaped for receiving a user's hands and arms therethrough such that a user can maneuver foodstuff positioned within a cavity of the sink 30 without getting his/her garment or apparel wet or stained, as shown in FIG. 4. Such openings 24 conveniently allow a user to have free movement of his/her arms and hands while working in close proximity to the sink 30. For use, an individual would simply place the item to be cleaned, scaled, and/or chopped, into the sink. The apparatus 10 is then be positioned on top of the sink. A user's hands and any applicable tool(s) would be inserted through the openings 24 and the cleaning or scaling task would be performed in the usual manner. Such an apparatus 10 provides a convenient and easily detachable protective barrier between debris and the kitchen countertop and nearby appliances.

Referring to FIGS. 1 and 2, the present invention 10 further includes a plurality of monolithically formed flange portions 40 protruding away from the opposed corners 21 of the body 20 such that the body 20 can be removably positioned on a support surface surrounding the perimeter of the sink 30. The outer surface 22 of the body 20 is preferably transparent such that a user can maintain a continuous line of sight into the sink 30 while standing exterior of the body 20.

Referring to FIGS. 1 and 3, the body 20 further may have a monolithically formed finger portion 41 medially situated between the openings 24 and engageable with the sink 30 perimeter for assisting to maintain the body 20 at a substantially stable position during operating conditions. Such a finger portion 41 enables a user to adjust the positioning of the body 20 without removing their hands therefrom, in the event such body 20 becomes dislodged or needs adjusting to ensure debris and fluid can not escape from the sink area.

The apparatus 10 provides a practical and attractive solution to maintaining the look of kitchen countertops, walls, floors, etc. It provides a cleaner, more sanitary method of cleaning and scaling or cutting fish, onions, and other food items, and would be particularly appealing to individuals who enjoy fishing. Such an apparatus 10 helps to maintain the appearance of a kitchen and would save homeowners a considerable amount of money. In addition, the apparatus 10 can be used in garages, utility rooms, or other places where sinks may be found, and where articles such as paint brushes and rollers are often washed, so that paint does not stain the interior of a home.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A detachable sink accessory for preventing undesirable fluids and food particles from escaping a sink cavity and contaminating surrounding areas, said sink accessory comprising:

a unitary and continuous body having opposed corners and an outer surface having a substantially dome shape covering a surface area of the sink, said body being situated forwardly of the faucet and extending upwardly from the sink and about a top perimeter thereof, said body further having a bottom surface maintaining continuous surface contact with a perimeter of the sink during operating conditions;

a plurality of openings equidistantly spaced along a front surface of said body, said openings extending upwardly from said bottom surface of said body and terminating subjacent to an apex of said body; and a plurality of monolithically formed flange portions protruding away from said opposed corners of said body such that said body can be removably positioned on a support surface surrounding the perimeter of the sink.

2. The sink accessory of claim 1, wherein said outer surface of said body is transparent such that a user can maintain a continuous line of sight into the sink while standing exterior of said body.

3. The sink accessory of claim 1, wherein the openings have a substantially arcuate shape.

4. The sink accessory of claim 1, wherein the openings are sized and shaped for receiving a user's hands and arms therethrough such that a user can maneuver foodstuff positioned within a cavity of the sink.

5. The sink accessory of claim 1, wherein said body further has a monolithically formed finger portion medially situated between the openings and being engageable with the sink perimeter for assisting to maintain said body at a substantially stable position during operating conditions.

6. A detachable sink accessory for preventing undesirable fluids and food particles from escaping a sink cavity and contaminating surrounding areas, said sink accessory comprising:

a unitary and continuous body having opposed corners and an outer surface having a substantially dome shape covering a surface area of the sink, said body being situated forwardly of the faucet and extending upwardly from the sink and about a top perimeter thereof, said body further having a bottom surface maintaining continuous surface contact with a perimeter of the sink during operating conditions;

a plurality of coextensive openings equidistantly spaced along a front surface of said body, said openings extending upwardly from said bottom surface of said body and terminating subjacent to an apex of said body; and a plurality of monolithically formed flange portions protruding away from said opposed corners of said body such that said body can be removably positioned on a support surface surrounding the perimeter of the sink.

7. The sink accessory of claim 6, wherein said outer surface of said body is transparent such that a user can maintain a continuous line of sight into the sink while standing exterior of said body.

8. The sink accessory of claim 6, wherein the openings have a substantially arcuate shape.

9. The sink accessory of claim 6, wherein the openings are sized and shaped for receiving a user's hands and arms therethrough such that a user can maneuver foodstuff positioned within a cavity of the sink.

10. The sink accessory of claim 6, wherein said body further has a monolithically formed finger portion medially situated between the openings and being engageable with the sink perimeter for assisting to maintain said body at a substantially stable position during operating conditions.

11. A detachable sink accessory for preventing undesirable fluids and food particles from escaping a sink cavity and contaminating surrounding areas, said sink accessory comprising:

a unitary and continuous body formed from non-corrosive material having opposed corners and an outer surface having a substantially dome shape covering a surface area of the sink, said body being situated forwardly of the faucet and extending upwardly from the sink and about a top perimeter thereof, said body further having a bottom surface maintaining continuous surface contact with a perimeter of the sink during operating conditions;

a plurality of coextensive openings equidistantly spaced along a front surface of said body, said openings extending upwardly from said bottom surface of said body and terminating subjacent to an apex of said body; and a plurality of monolithically formed flange portions protruding away from said opposed corners of said body such that said body can be removably positioned on a support surface surrounding the perimeter of the sink.

12. The sink accessory of claim 11, wherein said outer surface of said body is transparent such that a user can maintain a continuous line of sight into the sink while standing exterior of said body.

13. The sink accessory of claim 11, wherein the openings have a substantially arcuate shape.

14. The sink accessory of claim 11, wherein the openings are sized and shaped for receiving a user's hands and arms therethrough such that a user can maneuver foodstuff positioned within a cavity of the sink.

15. The sink accessory of claim 11, wherein said body further has a monolithically formed finger portion medially situated between the openings and being engageable with the sink perimeter for assisting to maintain said body at a substantially stable position during operating conditions.

* * * * *